US005860725A

United States Patent [19]

Zer et al.

[11] Patent Number: 5,860,725

[45] Date of Patent: Jan. 19, 1999

[54] HEAT OPERATED ROTATABLE DEVICE

[76] Inventors: Eliezer Zer, 6 Amos Street, Bnei Brak, Israel, 51366; Tzvi Klebanow, 65 HaPisga Street, Jerusalem, Israel, 96381

[21] Appl. No.: 839,090

[22] Filed: Apr. 23, 1997

[30] Foreign Application Priority Data

May 1, 1996 [IL] Israel ..... 118109

[51] Int. Cl.[6] ..... F21V 21/30; F21S 13/00

[52] U.S. Cl. ..... 362/35; 362/161; 362/209; 362/806; 40/441; 431/126; 431/295; 446/210

[58] Field of Search ..... 362/35, 96, 159–161, 362/174, 177, 209, 228, 229, 232, 806, 810; 40/411, 412, 421, 422, 440, 441, 479, 480; 211/1.53, 1.55; 431/126, 289, 295; 446/210

[56] References Cited

U.S. PATENT DOCUMENTS

| | | | |
|---|---|---|---|
| 90,441 | 5/1869 | Geisler | 446/210 |
| 154,285 | 8/1874 | Shultze | 446/210 |
| 563,077 | 6/1896 | Senge | 446/210 |
| 589,173 | 8/1897 | Henke | 40/441 |
| 939,705 | 11/1909 | Keller | 211/1.53 |
| 1,027,285 | 5/1912 | Schwager | 362/161 |
| 1,163,093 | 12/1915 | Krause | 446/210 |
| 1,282,212 | 10/1918 | Fulton | 446/200 |
| 1,521,448 | 12/1924 | Kraigel | 446/210 |
| 2,301,453 | 11/1942 | Reich | 431/126 |
| 2,310,019 | 2/1943 | Hamblet | 431/295 |
| 2,500,899 | 3/1950 | Leahan | 40/441 |
| 2,511,394 | 6/1950 | Wynnyk | 40/441 |
| 2,876,339 | 3/1959 | Thorne | 40/441 |
| 3,686,494 | 8/1972 | Naylor | 40/441 |
| 3,811,990 | 5/1974 | Stoff | 40/441 |
| 3,911,680 | 10/1975 | Blanchard | 60/529 |
| 3,983,653 | 10/1976 | Paige | 446/210 |
| 4,141,178 | 2/1979 | McGraw | 446/210 |
| 4,384,847 | 5/1983 | Schirneker | 362/161 |
| 4,827,382 | 5/1989 | Feliks | 362/35 |
| 4,835,663 | 5/1989 | Abbott et al. | 362/209 |
| 5,086,380 | 2/1992 | Hedner, Jr. | 362/161 |

*Primary Examiner*—Alan Cariaso
*Attorney, Agent, or Firm*—Darby & Darby

[57] ABSTRACT

This invention discloses a lamp shade assembly including a lamp shade, a plurality of vanes attached to the lamp shade, a pivot about which the lamp shade rotates, and a candle assembly located below said plurality of vanes, the candle assembly comprising a plurality of wicks with substantially different burning lives, the candle assembly when burning causing warmed air to rise and impinge upon the plurality of vanes, thereby causing rotation of the lamp shade.

16 Claims, 5 Drawing Sheets

HEAT OPERATED ROTATABLE DEVICE

FIELD OF THE INVENTION

The present invention relates to lampp shades generally and particularly to thermally rotated lamp shade assemblies.

BACKGROUND OF THE INVENTION

A thermally rotated lamp shade is a lamp shade which is rotated by means of warm air currents which impinge upon vanes attached to the lamp shade. The air may be warmed by a burning candle or a light bulb. Vaned lamp shades may be used as decorations, toys or advertising gimmicks, for example.

Thermally rotated lamp shades or similarly rotated devices are known in the art. The following U.S. Pat. Nos. are believed to be representative of the art: 90,441, 563,077, 589,173, 939,705, 1,163,093, 1,282,212, 1,521,448, 2,500,899, 3,811,990, 3,911,680, 3,983,653, 4,141,178 and 4,827,382.

SUMMARY OF THE INVENTION

The present invention seeks to provide an improved thermally rotated lamp shade.

There is thus provided in accordance with a preferred embodiment of the present invention, a lamp shade assembly including a lamp shade, a plurality of vanes attached to the lamp shade, a pivot about which the lamp shade rotates, and a candle assembly located below the plurality of vanes, the candle assembly including a plurality of wicks with substantially different burning lives, the candle assembly when burning causing warmed air to rise and impinge upon the plurality of vanes, thereby causing rotation of the lamp shade.

In accordance with a preferred embodiment of the present invention, the burn lives of the wicks are such that the initial heat generation of the candle assembly is transient and is sufficient to cause substantially immediate rotation of the lamp shade and the steady state heat generation is different than the initial heat generation.

Preferably the initial height of at least one candle of the candle assembly is sufficiently low such that the change in height of the at least one candle throughout its burning life does not substantially change the contribution of the at least one candle to the rotation of the lamp shade.

The candle assembly is preferably located in a disposable container which helps prevent messy deposits of wax falling on surfaces of the lamp shade assembly.

In accordance with a preferred embodiment of the present invention, the lamp shade assembly includes a self-extinguishing device. Preferably the self-extinguishing device includes a lid arranged for movement between non-extinguishing and extinguishing positions relative to the candle assembly, and a biasing device which, when resting on a surface, urges the lid into the non-extinguishing position and which when not resting on the surface, allows the lid to move into the extinguishing position, thereby extinguishing the candle assembly.

Additionally in accordance with a preferred embodiment of the present invention, the lamp shade includes a pivot post fixedly attached thereto which is pivotally supported by a deflector which deflects warm air towards the vanes.

Preferably the pivot post is supported in a depression formed in the deflector such that the pivot post is automatically seated in the depression by the force of gravity.

Preferably an end of the pivot post which is supported by the deflector is rounded. The lamp shade is preferably constructed of a high temperature resistant material.

Further in accordance with a preferred embodiment of the present invention, the lamp shade includes an exchangeable decorative design. Additionally or alternatively, the lamp shade includes a customized design.

In accordance with another preferred embodiment of the present invention, the lamp shade assembly includes a vertical array of more than one lamp shade, wherein a plurality of vanes associated with at least two of the lamp shades are configured such that the at least two lamp shades rotate in the same or opposite direction and at the same or different velocity.

BRIEF DESCRIPTION OF THE DRAWINGS

The present invention will be understood and appreciated more fully from the following detailed description, taken in conjunction with the drawings in which.

DETAILED DESCRIPTION OF THE PREFERRED EMBODIMENTS

Figure 1:
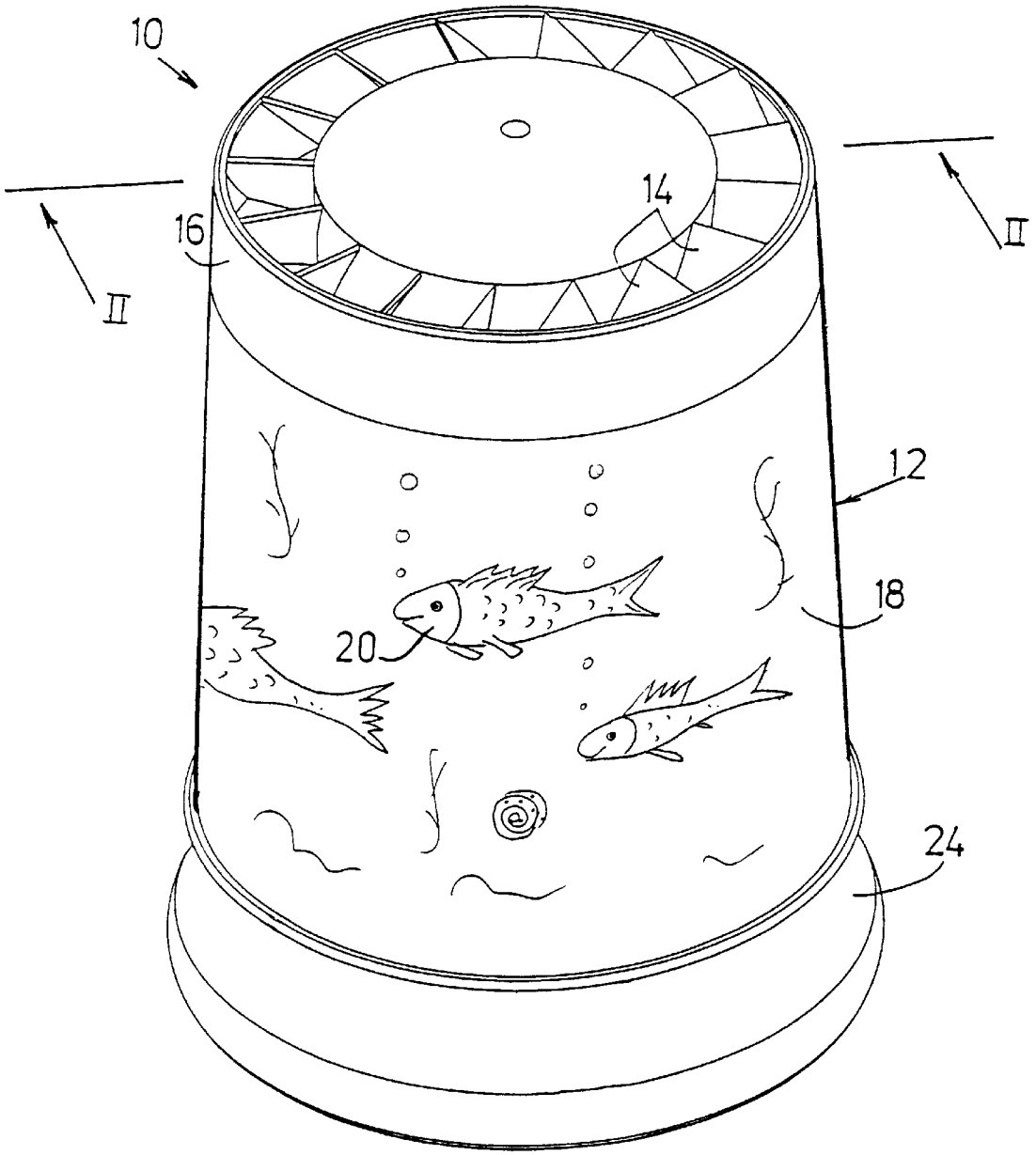
FIG. 1 is a simplified pictorial illustration of a thermally rotated lamp shade assembly, constructed and operative in accordance with a preferred embodiment of the present invention.
Figure 2:
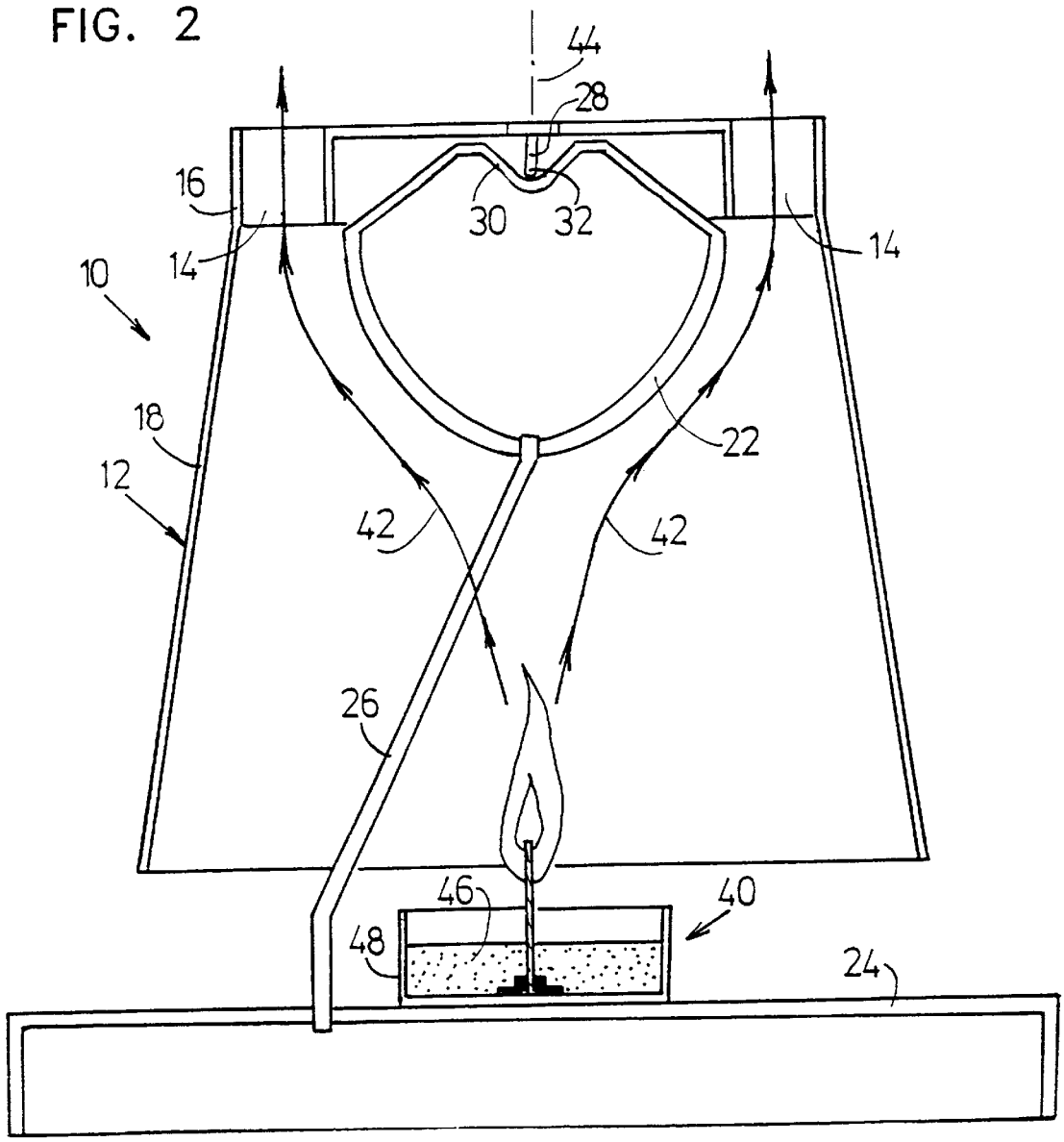
FIG. 2 is a simplified partially sectional illustration of the thermally rotated lamp shade assembly of FIG. 1, taken along lines II—II in FIG. 1.

Reference is now made to FIGS. 1 and 2 which illustrate a thermally rotated lamp shade assembly 10, constructed and operative in accordance with a preferred embodiment of the present invention.

Lamp shade assembly 10 preferably includes a lamp shade 12 and a plurality of vanes 14 attached to an upper portion 16 of lamp shade 12. Lamp shade 12 includes a body portion 18 preferably constructed of a high temperature resistant material, such as polycarbonate. Body portion 18 of lamp shade 12 may be transparent, translucent or opaque. Preferably a decorative design 20 is printed, silk-screened, etched or otherwise formed on body portion 18. The design 20 may be customized and may include advertising material, for example. Design 20 may also be exchangeable, that is, a body portion having a particular design may be easily removed from lamp shade assembly 10 and replaced with a body portion having another design. Alternatively, a design may be formed on a sheet (not shown) which may be selectively assembled on and/or removed from body portion 18 and may be exchanged with another sheet having a decorative design thereon.

Referring to FIG. 2, it is seen that lamp shade assembly 10 preferably includes a deflector 22 attached to a base 24 preferably by means of a bent pole 26. Preferably a pivot post 28 is fixedly attached to lamp shade 12 and is pivotally supported by deflector 22.

Figure 3:
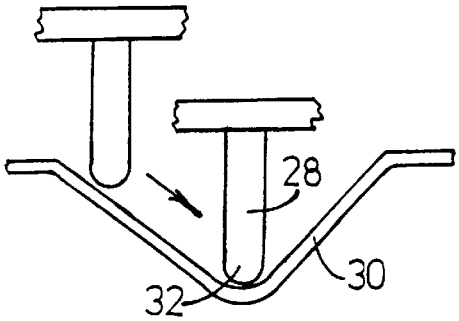
FIG. 3 is a simplified illustration of a pivot post of the lamp shade assembly of FIGS. 1 and 2.

Reference is now additionally made to FIG. 3, which further illustrates pivot post 28. In a preferred embodiment, pivot post 28 is supported in a depression 30 formed in deflector 22. As seen particularly in FIG. 3, the force of gravity causes pivot post 28 to be automatically seated in depression 30. An end 32 of pivot post 28 which sits in depression 30 is preferably rounded. Rotation of the rounded end 32 in depression 30 provides a bearing with a very low coefficient of friction, in contrast with needle point tips found in the prior art which may scratch their bearing surfaces with time, thereby increasing the coefficient of friction. Furthermore, the downwardly pointing rounded end 32 is safer than upwardly pointing sharp tips found in the art.

Reference is made again to FIG. 2. A candle assembly 40 is preferably mounted on base 24 below deflector 22 and vanes 14. Candle assembly 40, when lit, gives off heat which causes warmed air 42 to rise and impinge upon vanes 14, thereby causing rotation of lamp shade 12 generally about an axis 44.

Candle assembly 40 preferably includes a candle 46 which is relatively short compared to its width or diameter. It is a particular feature of the present invention that the initial height of candle 46 is sufficiently low such that the change in height of candle 46 throughout its burning life does not substantially change the contribution of candle 46 to the rotation of lamp shade 12. This obviates the need for devices found in the art for adjusting the height of relatively tall candles to compensate for the change in height during their burning life.

Candle 46 is preferably placed in a disposable container 48 which helps prevent messy deposits of wax falling on surfaces of lamp shade assembly 10 and retains the decorative appearance of the assembly 10.

In general, prior art thermally rotated lamp shades suffer from a problem of improper heating, either initial or steady state. Generally the candle or light bulb does not provide sufficient heat for producing warm air currents which can substantially cause immediate rotation of the lamp shade. Rather, there is usually a transient delay before rotation commences. Some prior art systems attempt to solve this problem by providing a large candle which gives off a large amount of heat to cause immediate rotation. However, the steady state level of heat generation is then too high, thereby causing too rapid rotation of the lamp shade.

Figure 4A:
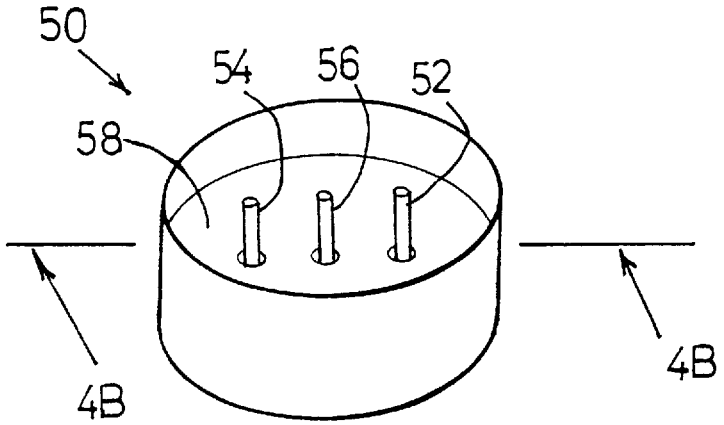
FIGS. 4A and 4B are simplified pictorial and sectional illustrations, respectively, of a candle assembly of the lamp shade assembly of FIG. 1, FIG. 4B being taken along lines 4B—4B in FIG. 4A.
Figure 4B:
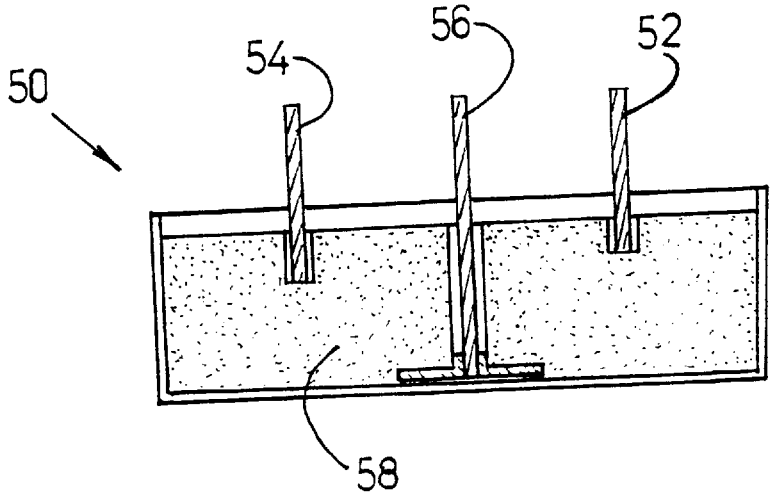

Reference is now made to FIGS. 4A and 4B which illustrate a candle assembly 50 useful in lamp shade assembly 10, and which helps to overcome the aforementioned problem of the prior art. Candle assembly 50 preferably includes a plurality of wicks, such as wicks 52, 54 and 56, with substantially different burning lives. For example, the burn lives of wicks 52, 54 and 56 may be 2, 5 and 120 minutes, respectively. The difference in burn lives of wicks 52, 54 and 56 is mainly due to the different depths into which the wicks are sunk in a wax 58 or other fuel. Wick 52, for example, is set relatively shallow in wax 58 and after only two minutes of burning, falls into a molten portion of wax 58 and becomes extinguished.

The burn lives of wicks 52, 54 and 56 are such that the initial heat generation of candle assembly 50 is sufficient to cause substantially immediate rotation of lamp shade 12 (not shown in FIGS. 4A and 4B). The heat generation gradually diminishes after the first 2 minutes of burning, and then after 5 minutes, the steady state heat generation is at a sufficient level so as to achieve a desired rotational velocity of lamp shade 12.

Figure 5:
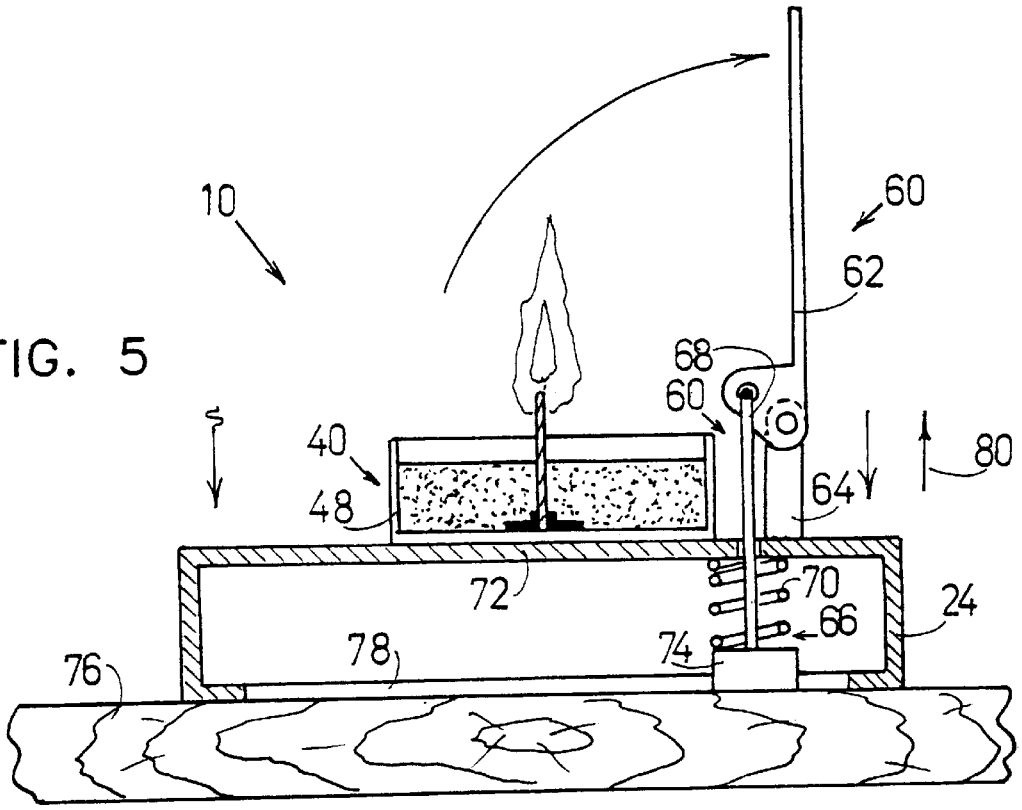
FIGS. 5 and 6 are simplified, partially sectional side view illustrations of a self-extinguishing device in the lamp shade assembly of FIG. 1, before and after extinguishing a flame, respectively.
Figure 6:
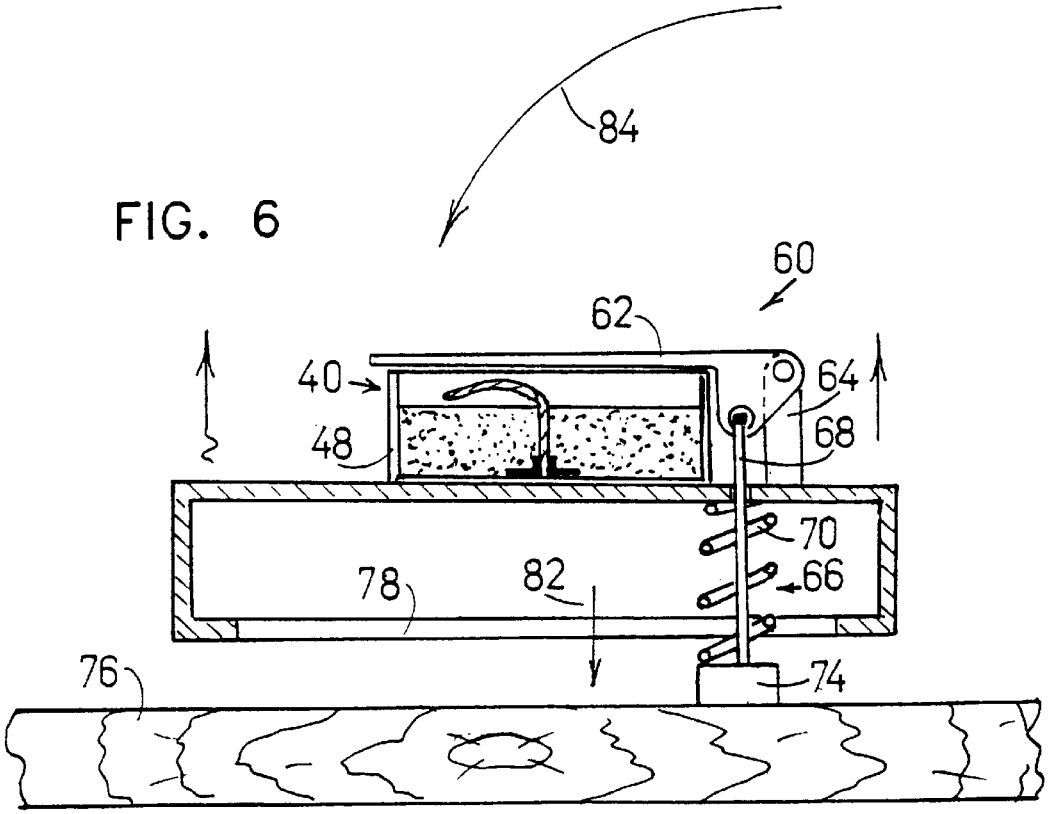

Reference is now made to FIGS. 5 and 6 which illustrate a self-extinguishing device 60 useful in lamp shade assembly 10. Self-extinguishing device 60 preferably includes a lid 62 which is pivotally supported by a post 64 which is attached to base 24. Lid 62 is preferably sized to be able to fully cover container 48 so as to extinguish candle assembly 40.

A biasing device 66 is preferably operatively connected to lid 62. In the illustrated embodiment, biasing device 66 preferably includes a rod 68 attached to lid 62 and a coil spring 70 which is arranged for applying a spring force against an underside 72 of base 24 and against a disk 74.

In FIG. 5, disk 74 rests on a mounting surface 76, preferably through an aperture 78 formed in base 24. In the orientation of FIG. 5, coil spring 70 urges rod 68 generally upwards in the direction of an arrow 80, thereby urging lid 62 into a non-extinguishing position, i.e., candle assembly 40 is free to burn and give off heat.

In FIG. 6, lamp shade assembly 10 has been lifted, tilted or moved, intentionally or unintentionally, from off mounting surface 76. Coil spring 70 thereupon urges disk 74 to protrude in the direction of an arrow 82 through aperture 78. At the same time, coil spring 70 urges rod 68 generally downwards in the direction of arrow 82, thereby rotating lid 62 downwards in the general direction of an arrow 84 into an extinguishing position, i.e., candle assembly 40 becomes extinguished.

Figure 7:
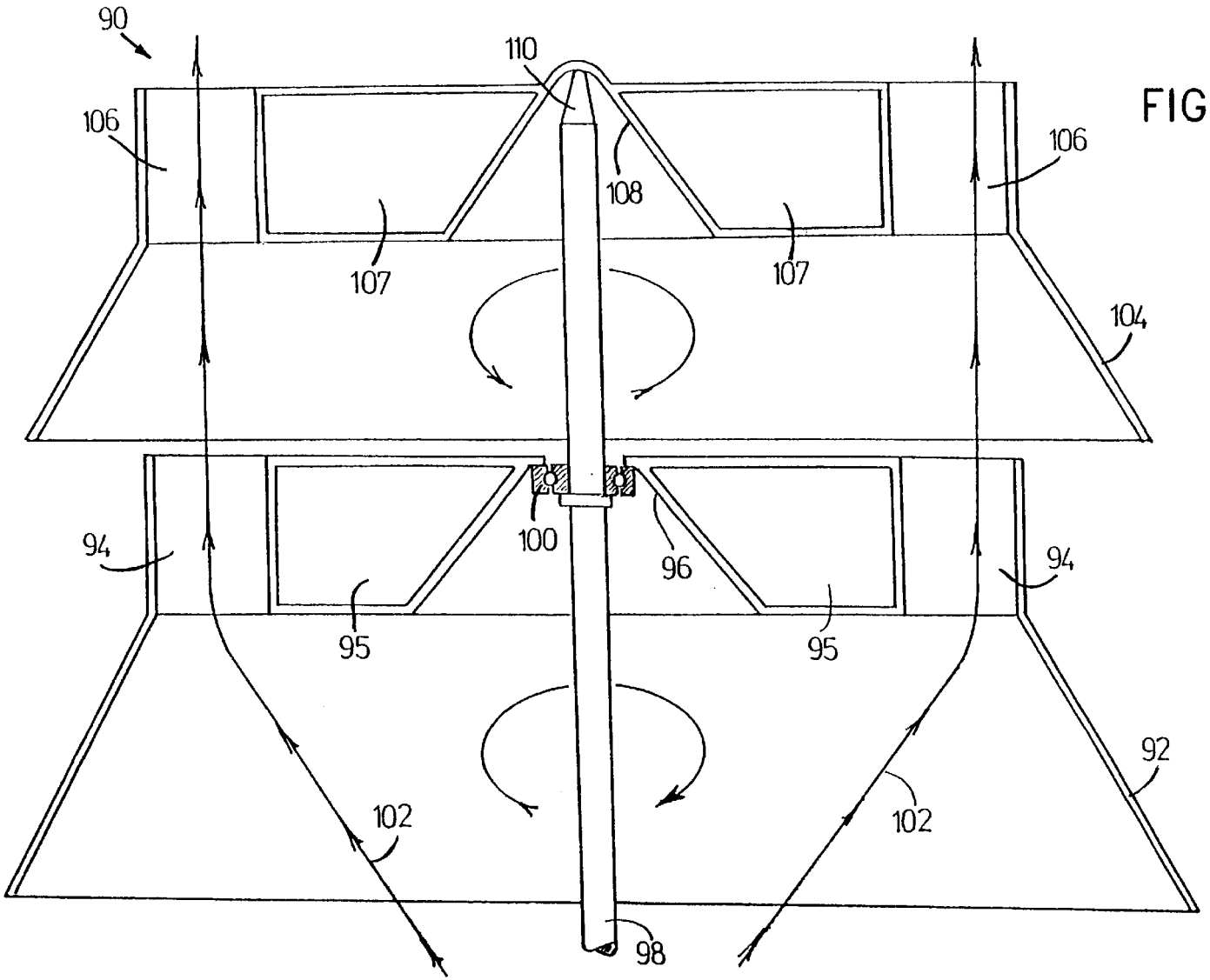
FIG. 7 is a simplified pictorial illustration of a multiple thermally rotated lamp shade assembly, constructed and operative in accordance with another preferred embodiment of the present invention.

Reference is now made to FIG. 7 which illustrates a multiple thermally rotated lamp shade assembly 90, constructed and operative in accordance with another preferred embodiment of the present invention.

Lamp shade assembly 90 preferably includes a lower lamp shade 92 to which are attached a plurality of vanes 94. A central hub 95 is preferably attached to vanes 94 and defines a generally conical surface 96. Lamp shade assembly 90 preferably includes a central post 98 to which is mounted a bearing 100. Conical surface 96 is preferably rotatably supported by bearing 100. Warm air currents 102, generated by a candle assembly (not shown), such as any of the previously described candle assemblies 40 and 50, rise and impinge upon vanes 94, thereby causing lamp shade 92 to rotate generally about central post 98. The velocity and direction of rotation of lamp shade 92 is determined, inter alia, by the pitch angle and direction of vanes 94.

Lamp shade assembly 90 preferably further includes an upper lamp shade 104 to which are attached a plurality of vanes 106. A central hub 107 is preferably attached to vanes 106 and defines a generally conical surface 108 which is preferably rotatably supported by an upper end 110 of central post 98. Alternatively, lamp shade 104 may be provided with a pivot post which is rotatably supported in a depression formed in upper end 110 of central post 98, in a similar manner as described hereinabove for lamp shade assembly 10 with reference to FIGS. 2 and 3.

Warm air currents 102, after having risen and impinged upon vanes 94, continue to rise and impinge upon vanes 106, thereby causing lamp shade 104 to rotate generally about post 98. The velocity and direction of rotation of lamp shade 104 is determined, inter alia, by the pitch angle and direction of vanes 106. Lamp shades 92 and 104 may rotate in the same or opposite direction and at the same or different velocity.

It is appreciated that various features of the invention which are, for clarity, described in the contexts of separate embodiments may also be provided in combination in a single embodiment. Conversely, various features of the invention which are, for brevity, described in the context of a single embodiment may also be provided separately or in any suitable subcombination.

It will be appreciated by persons skilled in the art that the present invention is not limited by what has been particularly shown and described hereinabove. Rather the scope of the present invention is defined only by the claims which follow:

We claim:

1. A lamp shade assembly comprising:

a lamp shade;

a plurality of vanes attached to the lamp shade;

a pivot about which said lamp shade rotates; and a candle assembly located below said plurality of vanes, said candle assembly comprising a plurality of wicks with substantially different burning lives, said candle assembly when burning causing warmed air to rise and impinge upon said plurality of vanes, thereby causing rotation of said lamp shade.

2. A lamp shade assembly according to claim 1 wherein the burn lives of said wicks are such that the initial heat generation of said candle assembly is transient and is sufficient to cause substantially immediate rotation of said lamp shade and the steady state heat generation is different than the initial heat generation.

3. A lamp shade assembly according claim 1 wherein an initial height of at least one candle of said candle assembly is sufficiently low such that a change in height of said at least one candle throughout its burning life does not substantially change the contribution of said at least one candle to the rotation of said lamp shade.

4. A lamp shade assembly according to claim 1 and wherein said candle assembly is located in a disposable container.

5. A lamp shade assembly according to claim 1 and comprising a self-extinguishing device adapted to extinguish said plurality of wicks.

6. A lamp shade assembly according to claim 5 wherein said self-extinguishing device comprises:

a lid arranged for movement between non-extinguishing and extinguishing positions relative to said candle assembly; and a biasing device which, when resting on a surface, urges said lid into said non-extinguishing position and which when not resting on said surface, allows said lid to move into said extinguishing position, thereby extinguishing said candle assembly.

7. A lamp shade assembly according to claim 1 and wherein said lamp shade comprises a pivot post fixedly attached thereto which is pivotally supported by a deflector which deflects warm air towards said vanes.

8. A lamp shade assembly according to claim 7 wherein said pivot post is supported in a depression formed in said deflector such that said pivot post is automatically seated in said depression by the force of gravity.

9. A lamp shade assembly according to claim 7 wherein an end of said pivot post which is supported by said deflector is rounded.

10. A lamp shade assembly according to claim 8 wherein an end of said pivot post which is supported by said deflector is rounded.

11. A lamp shade assembly according to claim 1 and wherein said lamp shade is constructed of a high temperature resistant material.

12. A lamp shade assembly according to claim 1 and wherein said lamp shade comprises an exchangeable decorative design.

13. A lamp shade assembly according to claim 1 and wherein said lamp shade comprises a customized design.

14. A lamp shade according to claim 1 and comprising a vertical array of more than one said lamp shade, wherein a plurality of vanes associated with at least two of said lamp shades are configured such that said at least two lamp shades rotate in different directions.

15. A lamp shade according to claim 1 and comprising a vertical array of more than one said lamp shade, wherein a plurality of vanes associated with at least two of said lamp shades are configured such that said at least two lamp shades rotate at different velocities.

16. A lamp shade assembly according to claim 2 wherein an initial height of at least one candle of said candle assembly is sufficiently low such that a change in height of said at least one candle throughout its burning life does not substantially change the contribution of said at least one candle to the rotation of said lamp shade.

* * * * *